US005647742A

United States Patent [19]

Sears et al.

[11] Patent Number: 5,647,742

[45] Date of Patent: Jul. 15, 1997

[54] MULTI-PANEL SPACER/SHIPPING BRACKET

[75] Inventors: Merle D. Sears, Mooresville; Howard E. Jameson, Indianapolis, both of Ind.

[73] Assignee: Carrier Corporation, Syracuse, N.Y.

[21] Appl. No.: 385,109

[22] Filed: Feb. 7, 1995

[51] Int. Cl.[6] ..... F27D 1/00

[52] U.S. Cl. ..... 432/247; 248/205.1

[58] Field of Search ..... 52/506.01, 506.02, 52/506.03, 731.7, 731.1; 248/346.02, 346.3

*Primary Examiner*—Henry A. Bennet

*Assistant Examiner*—Gregory Wilson

[57] ABSTRACT

A multi-panel spacer/shipping bracket for supportively spacing at least one panel located within a compartment, the bracket comprising: a base member; an attachment member extending therefrom and attached to the compartment; and a retention member extending from the base member, and further comprising an insertion member having a slot therein for retaining a panel, the slot defining an approach opening sized to receive the panel thereinto, and a spring member, positioned relative to the slot so as to operate to urge the panel against an interior vertical wall of the slot.

9 Claims, 4 Drawing Sheets

MULTI-PANEL SPACER/SHIPPING BRACKET

BACKGROUND OF THE INVENTION

1. Field of the Invention

This invention relates to a spacer usable for multiple panels which spacer functions as a support to the panels both during shipping of the panels and when the panels are in use functionally. More specifically this invention relates to a spacer for or bracket used to support heat exchange panels in a furnace during shipment and operation of the furnace.

2. Description of the Prior Art

Heat exchangers in a furnace are frequently made up of a set of individual heat exchange elements or panels which are arranged in a series of parallel planes. Each of the heat exchange panels is secured to the furnace in at least two places, the first being in the region of a burner from which the combustion products enter the heat exchanger, and the second to the collector box through which the cooled combustion products are eventually discharged via a vent from the furnace into the external environment. However, because the heat exchange panels are relatively large and heavy units, additional stability must be provided, both to maintain the heat exchange panels in a stable and spaced apart relationship during transportation of the furnace, and during operation of the furnace when they are subject to flow induced stress. In both cases the goal is to inhibit the heat exchange panels from being subjected to excessive movement within the furnace with the concomitant detrimental effect on the expectant lifetime of the panels, whether due to metal fatigue or impact with other elements of the furnace.

In the prior art furnaces manufactured by a common assignee, the heat exchange panels were supported by a bracket having therein symmetrical Y-shaped slots sized to accommodate and maintain the heat exchange panels by virtue of a solid interference fit between the slots and a planar portion of each heat exchange panel. This prior art bracket suffered from two problems. The first problem was that factory installation was complicated by the need to align the heat exchange panels with the bracket with relative precision in order to fit the heat exchange panels properly in place. The second problem was that with only an interference fit, there was a tendency of the heat exchange panel/bracket connection to loosen, allowing undesirable motion of the heat exchange panels. This could occur either in shipment where the panels were able to slip within the brackets, especially along the vertical axis of the slots, and during furnace operation.

The instant invention addresses this problem by, first, requiring less insertion force during the installation procedure, so that installation of the heat exchange panels into the bracket is simplified, and, second, by providing a spring loaded retention of the heat exchange panel against the bracket, so that dislodging the heat exchange panel becomes highly unlikely. In addition, the brackets are mounted higher in the furnace so that the heat exchange panels engage the interior bottoms of the Y-slots so that downward slippage of the panels during shipment cannot occur.

SUMMARY OF THE INVENTION

It is therefore a primary object of the present invention to provide an apparatus for maintaining the heat exchange panels of a furnace in a stable and spaced apart relationship during transportation and use of the furnace.

It is a further object of this invention to provide an apparatus for maintaining the heat exchange panels of a furnace in a stable and spaced apart relationship during transportation and use of the furnace, where the heats exchange elements are retained by the apparatus using spring tension.

It is yet a further object of this invention to provide an apparatus for maintaining the heat exchange panels of a furnace in a stable and spaced apart relationship during transportation and use of the furnace, where engagement of the heat exchange panels into the apparatus during the factory installation process is simplified.

It is still another object of this invention to provide an apparatus for maintaining the heat exchange panels of a furnace in a stable and spaced apart relationship during transportation and use of the furnace, where the apparatus is simple and easy to manufacture.

It is yet another object of this invention to provide an apparatus for maintaining the heat exchange panels of a furnace in a stable and spaced apart relationship during transportation and use of the furnace, where the spring member providing the spring tension is protected from damage during installation of the heat exchange panels into the furnace.

These and other objects of the present invention are attained by a multi-panel spacer/shipping bracket for supportively spacing at least one panel located within a compartment, the bracket comprising: a base member; an attachment member extending therefrom and attached to the compartment; and a retention member extending from the base member, and further comprising an insertion member having a slot therein for retaining a panel, the slot defining an approach opening sized to receive the panel thereinto, and a spring member, positioned relative to the slot so as to operate to urge the panel against an interior vertical wall of the slot.

According to another aspect of this invention, the slot is Y-shaped, and has first and second arm portions and a stem portion that respectively forms first and second angles with the first and second arm portions, with the first angle being unequal to the second angle.

According to still another aspect of this invention the first angle, on the spring side, is approximately 28 degrees, and said second angle is approximately 33 degrees, whereby the panel is easily received into the Y-shaped slot without damaging the spring member.

According to yet another aspect of this invention, the spring member extends downwardly at an obtuse angle from a corresponding top member, which is formed by bending inwardly a corresponding upstanding member, the upstanding member being that portion of the insertion member between pairs of slots or between one the slot and an edge of the insertion member.

According to still another aspect of this invention, the obtuse angle is between 130 and 140 degrees.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1B:
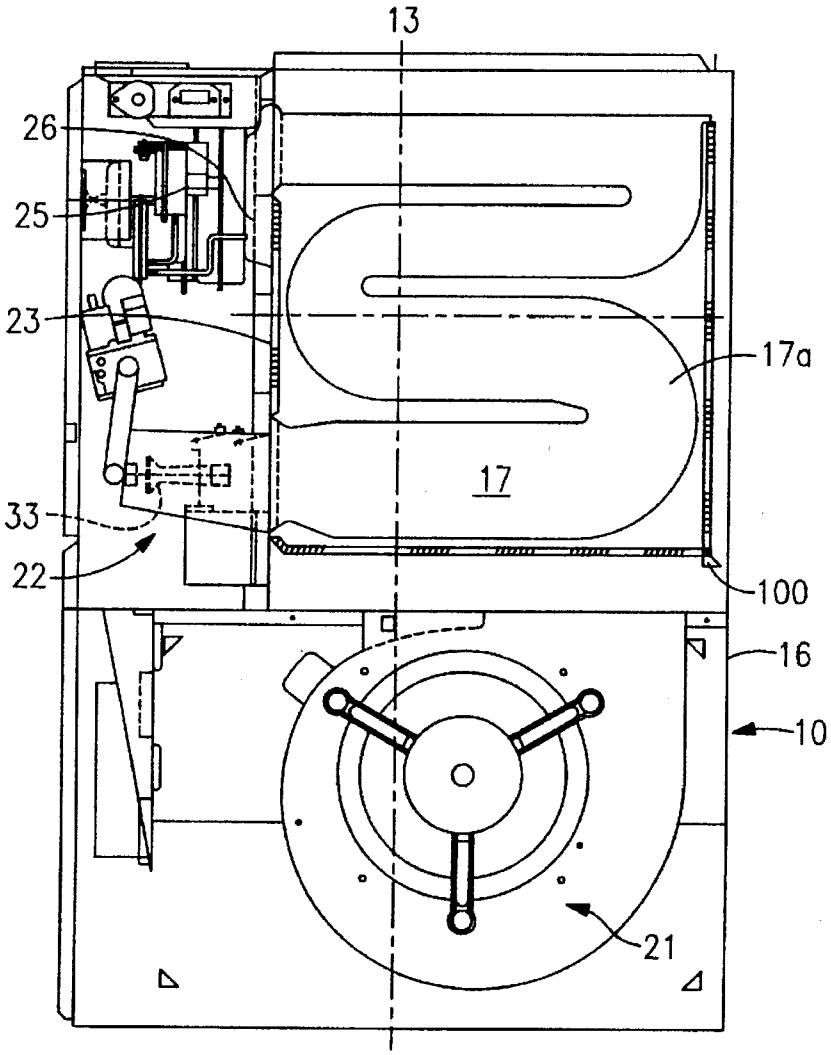
FIG. 1*b* is a sectional view of the spacer bracket of the instant invention, supporting a single heat exchange panel, in an upflow furnace.
Figure 1A:
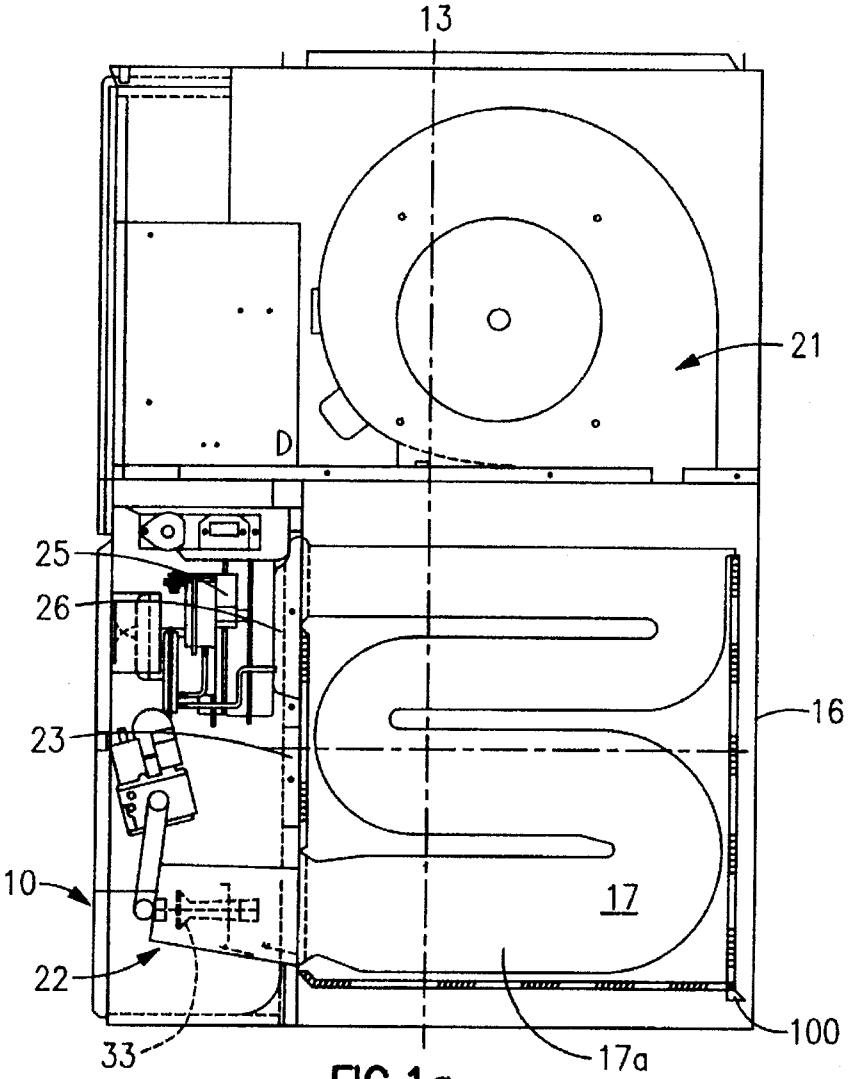
FIG. 1*a* is a sectional view of the spacer bracket of the instant invention, supporting a single heat exchange panel, in a downflow furnace.

Turning now to the Drawing and particularly, FIG. 1*a* and 1*b* thereof, the major operational components of a typical mid-efficiency furnace, denoted generally as 10, are shown. The primary heat exchanger 17 in this case is made up of a number of individual heat exchange panels, only one of which, 17*a* is shown, the others being in parallel planes thereto and to the surface of the drawing. A return air fan 21 forces return air drawn from a comfort zone through the return air duct (not shown), whereby the return air is passed over the heat transfer surface of the primary unit. A burner assembly 22 is attached to the vertical interior panel 23 in front of the entry ports (not shown) to each of the parallel primary heat exchange panels. The burner assembly contains a separate burner for servicing each panel which is adapted to inject high temperature flue gas products directly into the entrance of an associated heat exchange panel.

An inducer unit 25 is also secured to the collector box 26 and is operatively attached the vertical panel 23. The collector box 26 is attached to the discharge side of the primary heat exchanger. The inducer functions to pull flue gas products through the heat exchanger 17 and discharge the products out of the furnace. The supply air passing through the duct is forced over the heat transfer surfaces of each heat exchange panel.

FIGS. 1*a* and 1*b* show the bracket/spacer 100 of the instant invention installed in a downflow and an upflow furnace respectively. The bracket 100 is attached to the back wall 16 and individual heat exchange panels are supported in their rear sections by spring tension within prespaced retention members 110 of the spacer 100. The front of each heat exchange panel is supported in two positions by vertical interior panel 23 in the lower region by alignment with burner 33 and in the upper region by alignment with collector box 26 from which the cooled combustion products are discharged from the heat exchanger 17 outlets to inducer unit 25 inlet.

Figure 2:
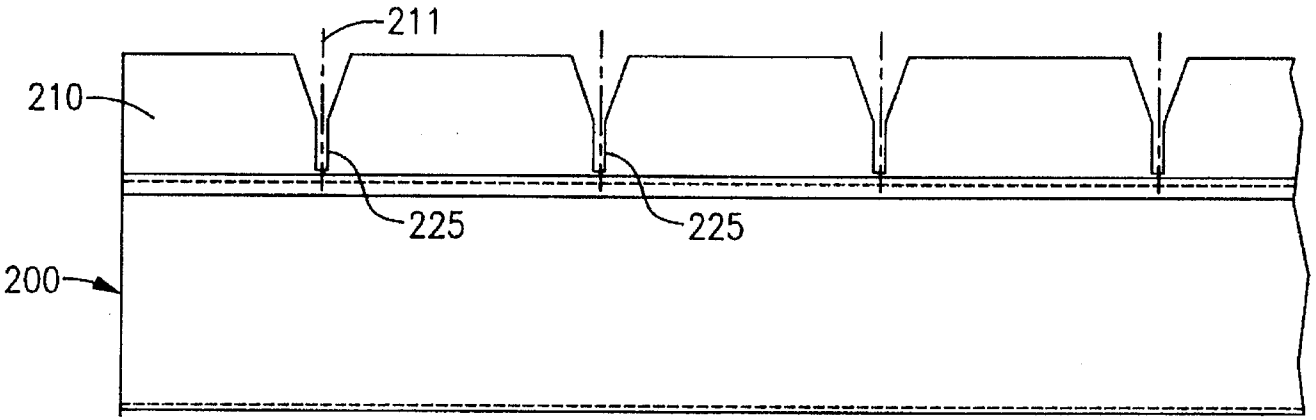
FIG. 2 is a partial front view of a prior art cell spacer.

FIG. 2 shows the cell spacer/bracket 200 of the prior art. Retention member 210 has excised therein a series of Y-shaped slots 225—225 which are cut out in the bracket 200 at regularly spaced apart intervals. These Y-shaped slots 225—225 are each symmetrical about a vertical axis 211. A portion of each heat exchange panel 17*a* may be engaged to fit snugly inside the walls of the base of a single Y-shaped slot 225 and is retained therein by virtue of an interference fit. In the prior art, the position in which the bracket was installed within the furnace was such that the bottoms of the heat exchange panels were not intended to engage the bottom interiors of the Y-slots 225—225.

Figure 5:
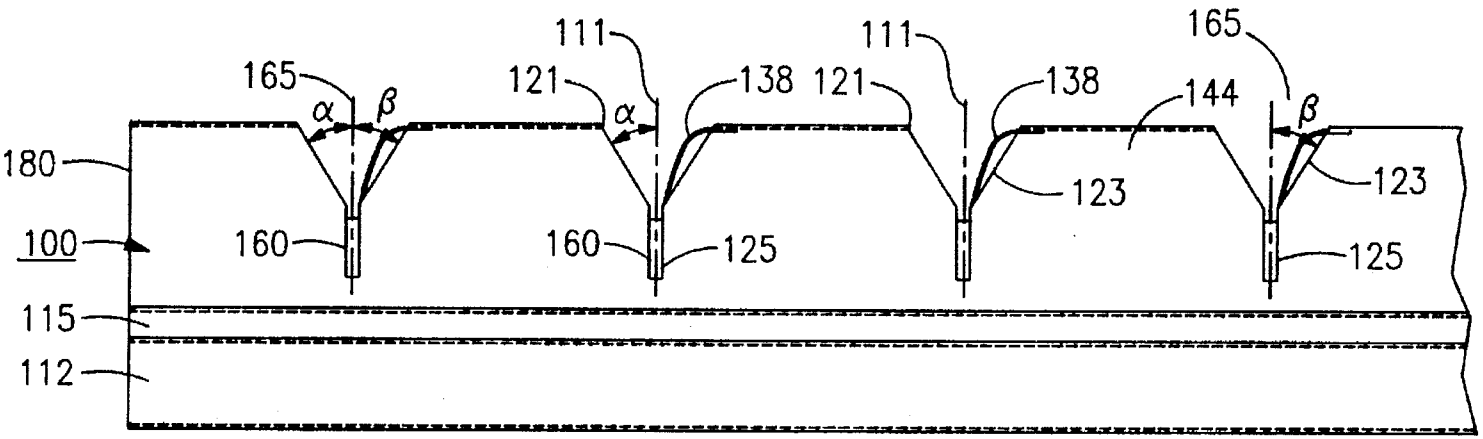
FIG. 5 is a front view of the invention of FIG. 3.
Figure 3:
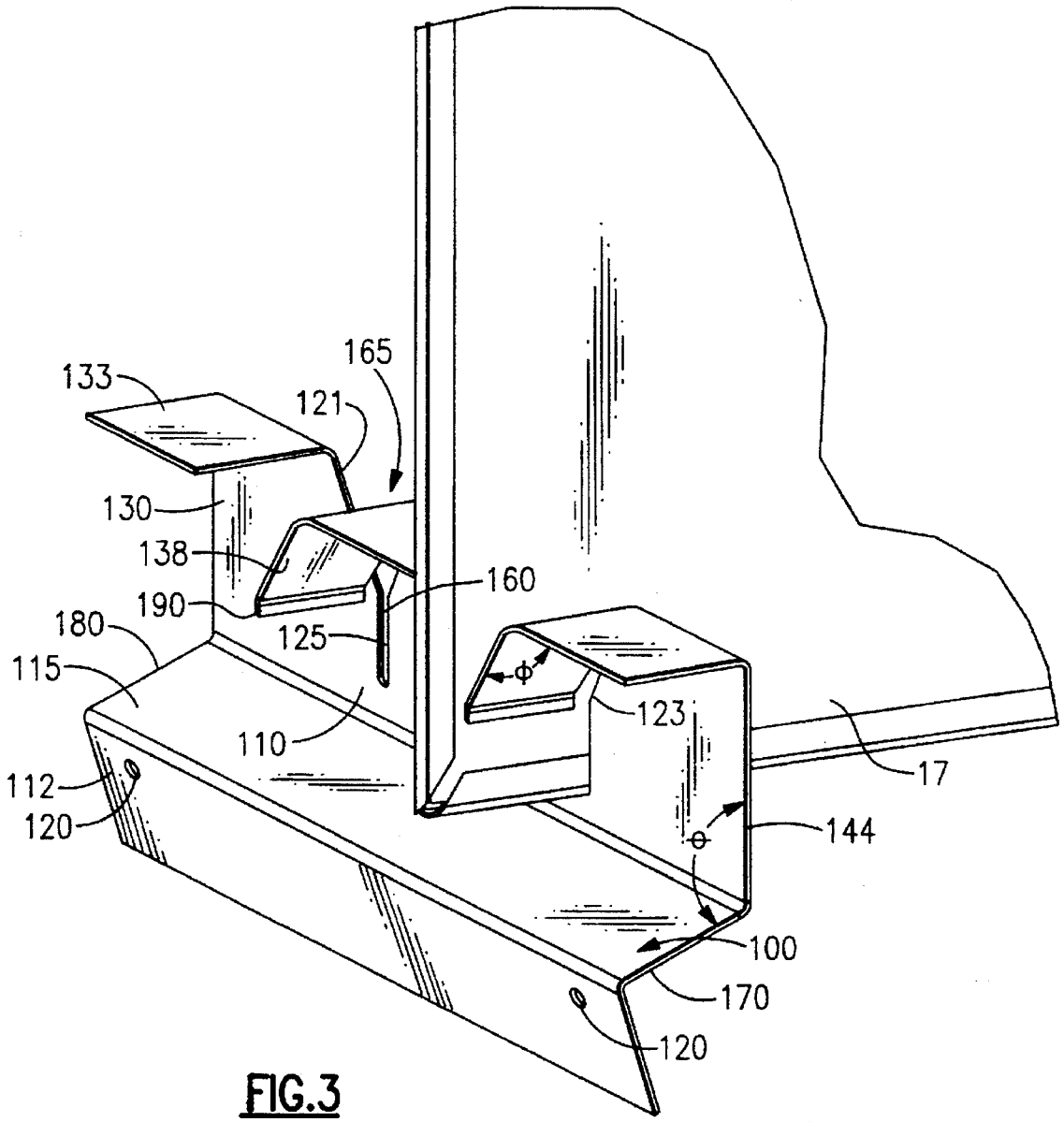
FIG. 3 is a perspective view of the front of the cell spacer/shipping bracket of the instant invention shown with a heat exchange panel engaged thereby.
Figure 4:
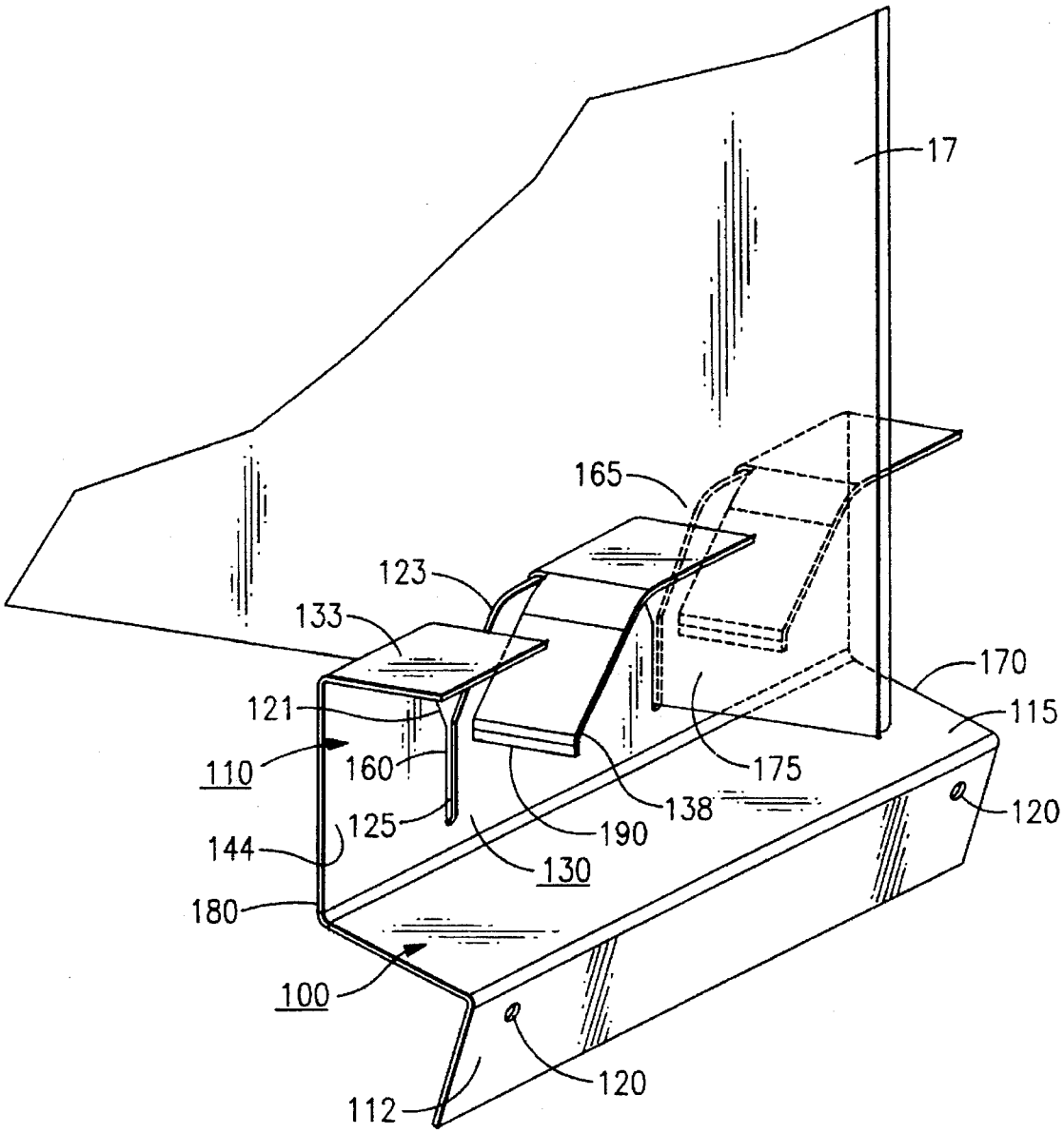
FIG. 4 is a rear perspective view of the invention of FIG. 3 with a segment thereof shown in phantom.

The features of the instant invention can best be understood by examining FIGS. 3 through 5. The cell spacer 100 is composed here of a single sheet of metal which has been die cut and bent to shape, although it may be formed of other suitable material such a plastic capable of withstanding the heat and strain of use, and having sufficiently elastic properties, and may be produced by other methods well known in the art such as die molding, injection molding and the like.

Base member 115 is shaped substantially as an elongated rectangle whose long axis is disposed at an approximately right angle to the main axis 13 of furnace 10, with a variance of ±3 degrees being acceptable. Attachment member 112 is also substantially rectangular and is disposed essentially parallel to the main axis of furnace 10, depends from the first long edge of base member 115, and has situated therein holes 120—120 for receiving a screw, bolt, nut, or other common attachment devices for attaching bracket 100 to the back wall 16 of furnace 10.

The retention member 130 which holds the primary heat exchanger 17, extends upwardly from the second long edge thereof, forming an angle $\theta$ with respect to base member 115. Angle $\theta$ is approximately 105° and may vary by ±5 degrees. Retention member 130, which serves to hold the heat exchange panels in place, is composed of a substantially rectangular insertion member 110, top members 133—133, and spring members 138—138. In insertion member 110 are situated at least one Y-shaped slot 125, having a vertical axis 111. If more than one, such Y-shaped slot is provided, all of the slots 125 are in a spaced apart relationship to one another. Each Y-shaped slot 125 is not symmetrical about the slot axis 11, but instead each slot 125 is cut out relatively deeply along one edge (the open edge) 123 thereof, so that each Y-shaped slot 125 has each of its two arm portions forming a unique angle with its stem portion with the angle on the spring side being smaller. In the preferred embodiment of the instant invention, the angle $\alpha$ on the open side is approximately 33° while the angle $\beta$ on the spring side is approximately 28°. Pairs of upstanding members 144 serve to define each slot 125 as does each respective edge 170, 180 of the insertion member 110 together with a single upstanding member 144. Each upstanding member 144 is bent inwardly to form a substantially rectangular top member 133 above the base member 115. Each top member 133, except for the one which extends between edge 180 of insertion member 110 and the relatively shallow cut edge 121 of the Y-slot 125 has extending downward therefrom a spring member 138. The upper portion of the Y-slot 125, bordered by relatively deeper edge 123 and relatively shallow edge 121 defines an approach opening 165. Each spring member 138 is perpendicular to insertion member 110 and gently curves as it extends downward to provide an obtuse opening angle $\phi$ of approximately 135° with respect to top member 133. Angle $\phi$ may way between approximately 130 and 140 degrees.

Spring 138 terminates in spring tab 190, bending downward therefrom at an obtuse angle. In use, the rear section of each heat exchange panel is fitted so that an edge thereof rests within the Y-slot 125. The relationship of the angles $\theta$, $\phi$, $\alpha$, and $\beta$ is such that all cooperate so that when heat exchange panel 17*a* is inserted into bracket 100, a sharp edge does not impinge against the panel 17*a* but rather spring tab 190 sits against panel 17*a* allowing easy removal thereof. This prevents damage to spring member 138.

Once in place, each spring member 138 presses against its respective heat exchanger panel urging back wall 175 thereof firmly in place against interior vertical wall 160 of slot 125 by means of spring tension. The spring tension enhances the interference fit, holding the primary heat exchanger 17 firmly in place during both shipping and furnace operation.

It is understood that while this bracket is used to support heat exchange panels within a furnace 10, it may also function to support any panels having a reasonably flat portion thereto within any compartment, for shipping or during use thereof.

While this invention has been explained with reference to the structure disclosed herein, it is not confined to the details set forth and this application is intended to cover any modifications and changes as may come within the scope of the following claims:

What is claimed is:

1. In conjunction with a furnace, having at least one heat exchange panel, and having a compartment within which the heat exchange panel is located, a multi-panel spacer/shipping bracket for supportively spacing at least one heat exchange panel, the bracket comprising:

a base member;

an attachment member extending from said base member, said attachment member attached to the compartment; and a retention member extending from said base member, said retention member further comprising:

an insertion member having a slot therein for retaining a panel, said slot defining an approach opening sized to receive the panel into said slot, and a spring member, said spring member positioned relative to said slot so as to operate to urge the panel against an interior vertical wall of said slot.

2. The multi-panel spacer/shipping bracket according to claim 1 wherein said slot is Y-shaped.

3. The bracket according to claim 2, wherein said Y-shaped slot has first and second arm portions and a stem portion that respectively forms first and second angles with said first and second arm portions, said first angle being unequal to said second angle.

4. The multi-panel spacer/shipping bracket according to claim 3 wherein said first angle on an open side of said Y-shaped slot is essentially 33 degrees and said second angle on a spring side of said Y-shaped slot is essentially 28 degrees, whereby the panel is easily received into said Y-shaped slot.

5. The multi-panel spacer/shipping bracket according to claim 1 wherein said spring member extends downwardly at an obtuse angle from a corresponding top member, said top member being formed by bending inwardly a corresponding upstanding member, said upstanding member being that portion of said insertion member between pairs of slots or between one said slot and an edge of said insertion member.

6. The multi-panel spacer/shipping bracket according to claim 5 wherein said spring member terminates in a spring tab.

7. The multi-panel spacer/shipping bracket according to claim 4 wherein said obtuse angle is between 130 and 140 degrees.

8. The multi-panel spacer/shipping bracket according to claim 7 wherein said obtuse angle is approximately 135 degrees.

9. The multi-panel spacer/shipping bracket according to claim 1 wherein said bracket is removably attachable to said compartment.

* * * * *